US009903681B2

(12) United States Patent
Walterscheid et al.

(10) Patent No.: US 9,903,681 B2
(45) Date of Patent: Feb. 27, 2018

(54) TOY ARROW FOR USE WITH TOY BOW

(71) Applicant: KMA Concepts Limited, Tsim Sha Tsui, Kowloon (HK)

(72) Inventors: Steve Walterscheid, Bend, OR (US); Brian K. Lapointe, South Dennis, MA (US); Peter J. Cummings, Kowloon (HK)

(73) Assignee: KMA Concepts Limited, TST, Kowloon (HK)

( * ) Notice: Subject to any disclaimer, the term of this patent is extended or adjusted under 35 U.S.C. 154(b) by 0 days.

(21) Appl. No.: 15/333,095

(22) Filed: Oct. 24, 2016

(65) Prior Publication Data

US 2017/0045326 A1 Feb. 16, 2017

Related U.S. Application Data

(63) Continuation of application No. 15/061,966, filed on Mar. 4, 2016, now Pat. No. 9,482,501, which is a continuation of application No. 14/591,837, filed on Jan. 7, 2015, now Pat. No. 9,310,171, which is a continuation-in-part of application No. 14/016,164, (Continued)

(51) Int. Cl.

| | |
|---|---|
| ***F41B 3/02*** | (2006.01) |
| ***A63H 33/18*** | (2006.01) |
| ***F42B 6/02*** | (2006.01) |
| ***A63H 27/14*** | (2006.01) |
| ***A63H 27/00*** | (2006.01) |
| ***F42B 6/04*** | (2006.01) |
| ***F42B 6/08*** | (2006.01) |
| *F41B 5/00* | (2006.01) |

(Continued)

(52) U.S. Cl.

CPC ..... *F41B 3/02* (2013.01); *A63H 27/005* (2013.01); *A63H 27/14* (2013.01); *A63H 33/18* (2013.01); *F42B 6/02* (2013.01); *F42B 6/04* (2013.01); *F42B 6/08* (2013.01); *F41B 5/0094* (2013.01); *F41B 5/10* (2013.01); *F41B 5/123* (2013.01)

(58) Field of Classification Search

CPC ..... F41B 5/0094; F41B 5/1411; F41B 3/02; F41B 7/08; A63H 33/18

USPC ..... 124/17, 20.1, 20.3, 23.1; 473/578

See application file for complete search history.

(56) References Cited

U.S. PATENT DOCUMENTS

| | | | |
|---|---|---|---|
| 613,386 | A | 11/1898 | McKenney |
| 667,630 | A | 2/1901 | Kratz-Boussac |

(Continued)

FOREIGN PATENT DOCUMENTS

| | | |
|---|---|---|
| CA | 2240141 | 6/1998 |
| CN | 2339261 Y | 5/1998 |

(Continued)

OTHER PUBLICATIONS

"LED Light Arrow Rocket Helicopter Flying Toy," Amazon.com, www.amazon.com/Amazing-Rocket-Helicopter-Flying-Elastic/dp/B00CV3NN4E/ref=pd_sbs_t_1, at least as early as Jan. 6, 2014, 7 pages.

(Continued)

*Primary Examiner* — Alexander Niconovich

(74) *Attorney, Agent, or Firm* — LaMorte & Associates P.C.

(57) ABSTRACT

A toy arrow that has a shaft with a head end and a tail end is described herein. A head is associated with the head end of the shaft. Fins are associated with the tail end of the shaft. Extending hooks extend outward from the sides of the head.

31 Claims, 7 Drawing Sheets

Related U.S. Application Data filed on Sep. 2, 2013, now Pat. No. 9,522,321, which is a continuation-in-part of application No. 13/902,968, filed on May 27, 2013, now Pat. No. 9,151,566, which is a continuation of application No. 12/878,985, filed on Sep. 9, 2010, now Pat. No. 8,662,060.

(51) Int. Cl.
*F41B 5/10* (2006.01)
*F41B 5/12* (2006.01)

(56) References Cited

U.S. PATENT DOCUMENTS 1,545,476 A * 7/1925 Austerman ..... F42B 6/04 446/54
1,572,270 A * 2/1926 Dwyer ..... A63H 27/00 124/17
2,268,487 A 12/1941 Jacobs et al.
2,417,267 A * 3/1947 Porter ..... A63H 27/007 446/62
2,525,332 A 10/1950 Alger et al.
2,555,420 A 6/1951 Richardson
2,621,441 A * 12/1952 Worden ..... A63H 5/00 40/413
2,666,643 A 1/1954 Miller
2,709,290 A 5/1955 Harry
2,748,529 A * 6/1956 Swan ..... F41B 3/02 102/348
2,782,036 A 2/1957 Folberth, Jr. et al.
2,796,262 A 6/1957 Folberth, Jr. et al.
2,876,485 A 3/1959 Cowles
2,882,055 A 4/1959 Meyer
2,997,809 A * 8/1961 Gladen ..... A63H 27/005 124/26
3,014,308 A * 12/1961 Parris ..... A63H 27/005 446/52
3,036,396 A 5/1962 Swails
3,050,805 A 8/1962 Clyne
3,071,127 A 1/1963 Spack
3,085,560 A * 4/1963 Peters ..... F42B 6/04 124/23.1
3,099,256 A * 7/1963 Halverson ..... F41B 3/02 124/20.3
3,126,880 A 3/1964 Loe
3,147,011 A 9/1964 Lemelson
3,168,961 A 2/1965 Yates
3,177,612 A * 4/1965 Giossi ..... A63H 27/004 446/64
3,390,480 A * 7/1968 Turner ..... A63H 27/12 446/45
3,445,954 A * 5/1969 Wahl ..... A63H 27/005 446/52
3,465,472 A * 9/1969 Novotny ..... A63H 27/005 446/52
3,539,187 A 11/1970 Smith
3,667,758 A 6/1972 Bengtsson
3,759,519 A 9/1973 Palma
3,834,368 A * 9/1974 Geiger ..... F41B 3/00 124/20.3
3,855,991 A 12/1974 Imatt et al.
3,918,427 A * 11/1975 Turner ..... F41B 3/02 124/16
3,954,266 A 5/1976 Carrano et al.
3,967,823 A 7/1976 Yount
4,003,576 A 1/1977 Carella
4,111,422 A * 9/1978 Burcenski ..... A63B 67/02 124/5
4,258,689 A 3/1981 Barnett
4,340,930 A 7/1982 Carissimi
4,369,013 A 1/1983 Abildgaard et al.
4,458,648 A 7/1984 Blair
4,458,658 A * 7/1984 Blair ..... F41B 3/02 124/20.1
4,671,249 A 6/1987 Troncoso
4,697,228 A 9/1987 Mui et al.
4,795,165 A 1/1989 Tehan
4,840,598 A 6/1989 Schuetz
4,856,792 A 8/1989 Hardison
4,900,037 A 2/1990 Miller
4,989,881 A 2/1991 Gamble
5,066,017 A 11/1991 Kurland
5,072,715 A 12/1991 Barr
5,230,650 A 7/1993 Brayton
5,247,920 A 9/1993 Harbin
5,279,513 A 1/1994 Connelly
5,282,453 A * 2/1994 Chia ..... F42B 6/00 124/20.1
5,320,359 A 6/1994 Harwell
D355,231 S 2/1995 Chien
5,415,151 A 5/1995 Fusi et al.
5,423,706 A * 6/1995 Chase ..... A63H 27/004 446/213
5,443,273 A 8/1995 Lovorn
5,830,029 A 11/1998 Siegel
6,042,494 A 3/2000 Rappaport et al.
6,247,990 B1 * 6/2001 Moorhouse ..... A63H 27/007 446/45
6,478,648 B1 11/2002 Applewhite
6,500,042 B1 * 12/2002 LaPointe ..... A63H 33/18 124/20.3
6,533,688 B1 3/2003 Huang
6,682,448 B2 1/2004 Jamison
7,001,292 B1 2/2006 Rappaport
7,037,164 B2 * 5/2006 Silverglate ..... A63H 27/14 124/16
7,052,357 B2 5/2006 Silverglate
7,229,371 B2 6/2007 Walsh
D546,409 S 7/2007 Perez
D599,412 S 9/2009 Sandman
7,640,922 B2 * 1/2010 Siebelink ..... F41B 3/005 124/17
7,686,002 B2 3/2010 Andrews
7,748,369 B2 * 7/2010 Chee ..... F41B 3/02 124/20.1
D622,325 S 8/2010 Walterscheid
7,803,033 B1 9/2010 Walterscheid
7,806,746 B2 10/2010 Walterscheid
7,862,457 B1 1/2011 Urcheck
7,874,947 B1 * 1/2011 Wolfinbarger ..... A63H 33/18 473/578
D637,239 S 5/2011 Walterscheid
D641,433 S 7/2011 Walterscheid
8,012,049 B1 9/2011 Walterscheid
8,287,034 B2 10/2012 Smith et al.
8,348,789 B1 1/2013 Walterscheid
8,366,573 B2 2/2013 Hunt
8,371,899 B1 2/2013 Walterscheid
8,382,616 B2 2/2013 Marshall
8,449,413 B1 5/2013 Jackson
8,485,168 B2 7/2013 Walterscheid
8,540,594 B2 9/2013 Chu
D698,872 S 2/2014 Cummings
8,662,060 B2 3/2014 Walterscheid et al.
8,689,773 B2 4/2014 Walterscheid et al.
8,852,038 B1 10/2014 Hyde
8,939,136 B2 * 1/2015 Gaus ..... F41F 7/00 124/4
9,091,514 B1 7/2015 Cummings
9,476,666 B1 * 10/2016 Larner ..... F41B 5/1403
2006/0011189 A1 1/2006 Simo
2008/0156307 A1 * 7/2008 Myers ..... F41B 3/02 124/20.1
2008/0295816 A1 12/2008 Edwards
2009/0032002 A1 2/2009 Howard et al.
2009/0301455 A1 12/2009 Yamashiro et al.
2009/0309307 A1 * 12/2009 Leal ..... A63B 63/00 273/348.4
2009/0314272 A1 * 12/2009 Lin ..... F41A 9/74 124/48
2010/0255939 A1 10/2010 York
2011/0041820 A1 2/2011 Stanziale

(56) References Cited

U.S. PATENT DOCUMENTS

| | | | | |
|---|---|---|---|---|
| 2012/0060807 | A1 | 3/2012 | Walterscheid | |
| 2012/0031812 | A1 | 4/2012 | Paggi | |
| 2012/0160224 | A1 | 6/2012 | Walterscheid | |
| 2012/0174345 | A1 | 7/2012 | Scroggie et al. | |
| 2013/0031756 | A1 | 2/2013 | Yuen | |
| 2013/0055994 | A1 | 3/2013 | Walterscheid | |
| 2013/0167819 | A1 | 7/2013 | Walterscheid | |
| 2013/0263838 | A1 | 10/2013 | Cummings | |
| 2014/0000577 | A1 | 1/2014 | Cummings | |
| 2014/0256479 | A1* | 9/2014 | Bynum, Jr. | F42B 6/08 473/470 |
| 2014/0338647 | A1 | 11/2014 | Cummings | |
| 2015/0119174 | A1 | 4/2015 | Cummings | |
| 2015/0176940 | A1 | 6/2015 | Cummings | |

FOREIGN PATENT DOCUMENTS

| | | | |
|---|---|---|---|
| CN | 2536273 | Y | 9/2001 |
| CN | 2595415 | | 12/2002 |
| CN | 2676978 | Y | 12/2003 |
| CN | 101266121 | A | 3/2007 |
| CN | 202052300 | U | 4/2011 |
| FR | 2761610 | | 10/1998 |
| GB | 2255289 | | 4/1992 |
| GB | 2255289 | | 11/1992 |
| JP | 2008229285 | A | 3/2007 |
| TW | 509093 | U | 9/2001 |
| WO | WO2013133853 | | 9/2013 |

OTHER PUBLICATIONS

"LED Arrow Helicopter," DHgate,com, copyright ©2004-2013 DHgate.com, at least as early as Dec. 6, 2013, 9 pages.

"Arrowcopter Flying Light," Amazon.com, www.amazon.com/Sling-Copter-Arrowcopter-Flying-Light/dp/B003LYIT10/ref=pd_sbs_t_9, at least as early at Jan. 6, 2014, 3 pages.

"Marble Copters Light Up Helicopter," Skullduggery, Amazon.com, www.amazon.com/Skullduggery-Marble-Copters-Light-Helicopter/dp/B007XWSLGI, at least as early as Jan. 6, 2014, 4 pages.

"Nockturnal™ Lighted Arrow X Nock—3-Pack," www.cabelas.com, ©1996-2014 Cabela's Inc., 1 page.

"K-Resin® Styrene-Butadiene Copolymers, The Smart Choice™," Chevron Phillips Chemical Company LP, www.cpchem.com, www.k-resin.com, Mar. 2011, 13 pages.

"BestDealUSA Slingshot Helicopter LED Flashing Children Fly 50m High," Sling Copter, Amazon.com, www.amazon.com/BestDealUSA-Slingshot-Helicopter-Flashing-Children/dp/B008JA0MBK/ref=sr_1_10, at least as early as Jan. 6, 2014, 2 pages.

"Flexo® Super Duty Heavy Duty Technical Data Sheet," Techflex, www.techflex.com, ©2009 Techflex, Inc., 2 pages.

"T-H FlexTM Expandable Braided Sleeving," www.thmarine.com, ©2001-2013 T-H Marine Supplies, at least as early as Nov. 14, 2013, 1 page.

ISA/US, "International Search Report," dated Jun. 22, 2012, Patent Cooperation Treaty, 2 pages.

Groupon, "The Black Series Toy Bow and Target Set. Free Returns," web page, http://www.groupon.com/deals/gg-th-black-series-toy-bow-and-target-set, at least as early as Dec. 29, 2014, 3 pages.

Bed Bath & Beyond, "Black Series Bow and Arrow Set with Targets," web page, http://www.bedbathandbeyond.com/1/1/255930-black-series-bow-arrow-set-targets.html, at least as early as Oct. 27, 2014, 3 pages.

Phoenix Behavior.com, "7 Piece Archery Target Set," web page, http://phoenixbehavior.com/sale-product-online/db0ee0f38edb31acf3500a49dfb2241ff06a2286db994/the-black-series-indoor-outdoor-7-piece-archery-set, 4 pages'.

Marek, Alison, "More Than 180 Videos From Pomona!," Apr. 2009, TDmonthly®, Copyright ©2014 TDmonthly®, a division of ToyDirectory.com®, Inc., 10 pages.

TDmonthly®, Copyright ©2015 TDmonthly®, a division of ToyDirectory.com®, Inc., at least as early as Apr. 2009, 3 pages of screen captures, http://www.toydirectory.com/monthly/video/video2.asp?clip=1TRADESHOW/Pomona09/ZingT-Zartz.swf.

Marek, Alison and Jones Julie L., "Fast, Cheap and Under Control," Jul. 2007, TDmonthly®, Copyright ©2014 TDmonthly®, a division of ToyDirectory.com®, Inc., 26 pages.

TDmonthly®, Copyright ©2015 TDmonthly®, a division of ToyDirectory.com®, Inc., at least as early as Jul. 2007, 2 pages of screen captures, http://www.toydirectory.com/monthly/video/video.asp?clip=22640.

Dave & Busters, Kmart, Farmer'S Catalog, Canadian Toy Fair, Photographs of Similar Products, at least as early as Sep. 30, 2015, 11 pages.

Shao, Jiamu, "A Structure Improvement of the Dartlike Weapon," filed May 25, 1998, machine translation CN2339261Y (FR05), State Intellectual Property Office of the P.R.C., Aug. 10, 2015, 5 pages.

Huang Guohua, "The Luminous Rotatable Dartlike Weapon of the Dartlike Weapon Wing That Reaches," filed Sep. 25, 2001, machine translation CN2536273Y (FR06), State Intellectual Property Office of the P.R.C., Aug. 11, 2015, 14 pages.

Wu Yunmi, "The Combined Type Strengthens the Body to Dart," CN2595415, filed Dec. 17, 2002, machine translation CN2595415 (FR07), State Intellectual Property Office of the P.R.C., Aug. 10, 2015, 5 pages.

Fuxiang Industrial Co., Ltd., "The Flash of Light Dartlike Weapon," filed Dec. 10, 2003, machine translation CN2676978Y (FR08), State Intellectual Property Office of the P.R.C., Aug. 11, 2015, 18 pages.

Nie Xiaoqing, "A Link Construction that the Dartlike Weapon Pole and the Dartlike Weapon Wing of Dartlike Weapon," filed Mar. 12, 2007, machine translation CN101266121A (FR09), State Intellectual Property Office of the P.R.C., Aug. 10, 2015, 31 pages.

Ju Erlin, "A Dartlike Weapon Fin," filed Apr. 18, 2011, machine translation CN202052300U (FR10), State Intellectual Property Office of the P.R.C., Aug. 10, 2015, 9 pages.

Jinta Serizawa, "Dart Flight," filed Oct. 2, 2008, machine translation JP2008229285A (FR11), Japan Platform for Patent Information, Aug. 11, 2015, 16 pages.

Huang Guohua, "Darts and Dart Having a Light Emitting Structure of the Wing Can be Rotated," filed Sep. 13, 2001, machine translation TW509093U (FR12), Taiwan Intellectual Property Office via Google Translate, Aug. 10, 2015, 18 pages.

International Search Report and Written Opinion, Patent Cooperation Treaty (PCT), PCT/CN2014/074870, filed Apr. 4, 2014 (Apr. 4, 2014), dated Dec. 31, 2014 (31.12.2914), 11 pages.

Merchsource, "HSL-2nd Shot Arrow," email communication with attachments, at least as early as Nov. 4, 2013, 4 pages.

* cited by examiner

TOY ARROW FOR USE WITH TOY BOW

The present application is a continuation of U.S. patent application Ser. No. 15/061,966, filed Mar. 4, 2016. U.S. patent application Ser. No. 15/061,966 is a continuation of U.S. patent application Ser. No. 14/591,837, filed Jan. 7, 2015, now U.S. Pat. No. 9,310,171. U.S. patent application Ser. No. 14/591,837 is a continuation-in-part of U.S. patent application Ser. No. 14/016,164, filed Sep. 2, 2013. U.S. patent application Ser. No. 14/016,164 is a continuation-in-part application of U.S. patent application Ser. No. 13/902,968, filed May 27, 2013, which issued as U.S. Pat. No. 9,151,566 on Oct. 6, 2015. U.S. patent application Ser. No. 13/902,968 is a continuation-in-part application of U.S. patent application Ser. No. 12/878,985, filed Sep. 9, 2010, which issued as U.S. Pat. No. 8,662,060 on Mar. 4, 2014. The present application is based on and claims priority from these applications, the disclosures of which are hereby expressly incorporated herein by reference.

BACKGROUND OF THE INVENTION

Field of the Invention

In general, the present invention relates to a toy arrow for use with a toy bow in toy bow and arrow systems, where the toy bow is used to launch the toy arrow projectile into flight.

Prior Art Description

Bow and arrow sets that are designed for children's play have existed throughout recorded history. In the modern era, toy bow and arrow sets typically have a plastic molded bow, a string, and safety-tipped arrows. To ensure safety, the functional design of a toy bow is also commonly altered. In a real bow, the string has a fixed length. The spring force used to launch an arrow comes from the flexing of the arms of the bow. The problem with this design is its failure mode. If a bow is drawn beyond its limit, then the arms or the string of the bow may break. Depending upon where the breakage occurs, the broken string and/or bow may fly toward the person holding the bow as the stored energy is accidentally released.

To reduce the likelihood of this hazard occurring, many toy bows are manufactured as static structures. An elastic string is used to create the arrow launching force. If such a bow is overdrawn, there is no significant chance of the bow breaking. Rather, the elastic string will break and will most likely move in a direction away from the person drawing the bow. The failure mode of a string breaking is far less dangerous than the failure mode of the bow breaking. However, the failure mode of a broken string does present some danger depending upon where the elastic string breaks and how much energy is stored in the elastic string at the time it breaks.

Toy bows that use a static bow and an elastic string are exemplified by U.S. Pat. No. 5,247,920 to Harbin, entitled Toy Bow; and U.S. Pat. No. 7,748,369 to Chee, entitled Launching Apparatus and Assembly.

Many toy bows that have elastic strings use elastic strings that are made from a synthetic polymer, such as silicone, TPR, or some other synthetic rubber. On the toy, such elastic strings are constantly under tension. As such, if the material of the string creeps or degrades, the elastic string will break. This stops the toy bow from being functional.

Most all plastic degrades in some fashion over time. However, it has been found that one of the fastest ways to degrade the preferred polymers used for the bowstring is to expose the bowstring to UV light. A bowstring that can last for months inside a home may only last for a few days if taken outside and left in sunlight. A toy that lasts for months is acceptable. A toy that lasts for days is not. Damage caused by exposure to light has therefore caused products to be returned and/or consumer's dissatisfaction with the toy manufacturer.

A need exists for a toy bow and arrow design that inhibits degradation in the elastic string caused by exposure to light. This need is met by the present invention as described and claimed below. A need also exists for a toy bow and arrow design that inhibits degradation in the elastic string caused by exposure to UV light, yet provides enhanced aesthetics using internal lighting that does not contain significant UV wavelengths. This need is met by the present invention as described and claimed below.

SUMMARY OF THE INVENTION

Described herein is a toy projectile that has extending hooks. The hooks on the projectile engage the elastic elements. When the projectile is drawn back, the elastic elements stretch and provide the spring energy needed to launch the projectile into flight when it is released.

Described herein is a toy projectile that has a shaft with a head end and a tail end. A head is associated with the head end of the shaft. Fins are associated with the tail end of the shaft. Extending hooks extend outward from the sides of the head. The head may be an enlarged head. The extending hooks may be a pair of extending hooks extending outward from opposite sides of the head. Preferably, a first end of each of the extending hooks is associated with the head, a second end of each of the extending hooks is distal from the head, and the second end extends towards the shaft and the fins.

Described herein is a toy bow assembly that is used to launch toy projectiles. The toy bow assembly includes a bow structure having a first arm section and a second arm section. Both the first arm section and the second arm section have sheathed areas that are protected from ambient light. A central area is disposed between the first arm section and the second arm section.

A first elastic element is anchored to the first arm section. The first elastic element extends through the first sheathed area into the central area, wherein the first sheathed area shields the first elastic element from exposure to ambient light. Likewise, a second elastic element is anchored to the second arm section. The second elastic element extends through the second sheathed area and into the central area, wherein the second sheathed area shields the second elastic element from exposure to ambient light. This prevents the elastic elements from degrading due to exposure of UV light contained in ambient light.

Described herein is a toy bow assembly that is used to launch toy projectiles. The toy bow assembly includes a bow structure having a first arm section and a second arm section. Both the first arm section and the second arm section contain at least one translucent area.

Lights are disposed within both the first arm section and the second arm section. The lights internally illuminate the translucent areas of the first arm section and second arm section when activated.

An activation switch is disposed on the bow structure for selectively activating and deactivating the lights.

A first elastic element is anchored to the first arm section. The first elastic element extends through the first arm section into a central area. The first arm section shields the first elastic element from exposure to ambient light. Likewise, a second elastic element is anchored to the second arm section. The second elastic element extends through the second arm section and into the central area. The second arm section shields the second elastic element from exposure to ambient light. This prevents the elastic elements from degrading due to exposure of UV light contained in ambient light.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

In prior U.S. patent application Ser. No. 13/902,968, now issued as U.S. Pat. No. 9,151,566 on Oct. 6, 2015, the applicant presented a toy bow where the elastic bowstring was encased and protected from UV light in the ambient atmosphere. However, in shielding the bowstring, the toy bow lost some aesthetics. The shielding over the bowstring, however, provided an opportunity to provide unique improved aesthetics through the use of internal lighting, and this is shown in U.S. patent application Ser. No. 14/016,164. This patent and application are combined in the present application. Like elements are referred to with like reference numbers.

Whereas the parent application focuses on the toy bow, the present application focuses on the toy arrow that is shown and described in U.S. patent application Ser. No. 13/902,968, now U.S. Pat. No. 9,151,566, issued Oct. 6, 2015, and U.S. patent application Ser. No. 14/016,164 as well as U.S. patent application Ser. No. 12/878,985, now U.S. Pat. No. 8,662,060, issued Mar. 4, 2014 (which is the parent of both U.S. patent application Ser. No. 13/902,968 now issued as U.S. Pat. No. 9,151,566 and U.S. patent application Ser. No. 14/016,164).

Specifically described herein is a toy projectile 14 (also referred to as an arrow projectile, a projectile, or a toy arrow) that has extending hooks 20. The hooks 20 on the toy projectile 14 engage the elastic elements of the toy bow 12. When the projectile 14 is drawn back, the elastic elements stretch and provide the spring energy needed to launch the projectile 14 into flight when it is released. Unless specified otherwise, the toy projectile 14 (FIGS. 1 and 4) and the toy projectile 14' (FIG. 7) are described together as toy projectile 14.

Although the toy bow and arrow system can be embodied in many ways, only the shown exemplary embodiments of the present invention system are illustrated. These embodiments are selected in order to set forth the best mode contemplated for the invention. The illustrated embodiments, however, are merely exemplary and should not be considered a limitation when interpreting the scope of the appended claims.

Figure 1:
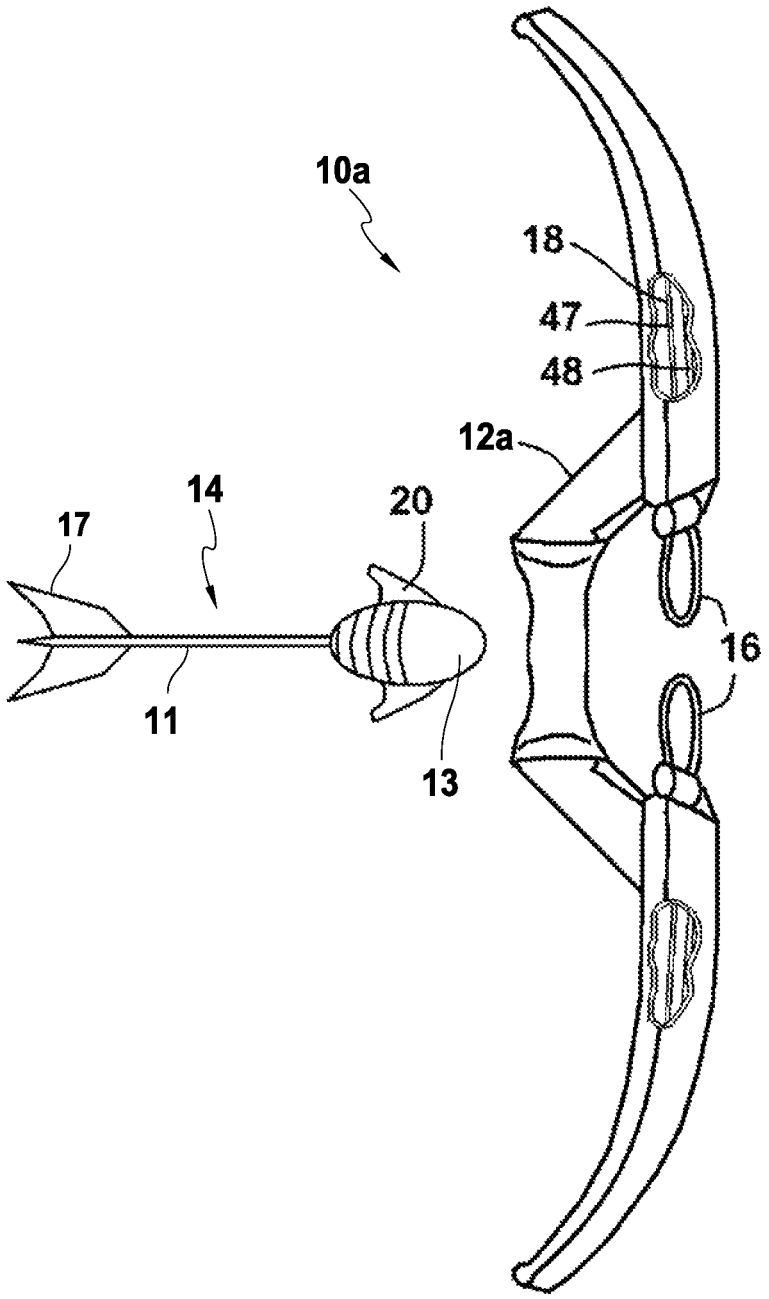
FIG. 1 is a perspective view of an exemplary embodiment of a toy bow and toy projectile in combination.
Figure 4:
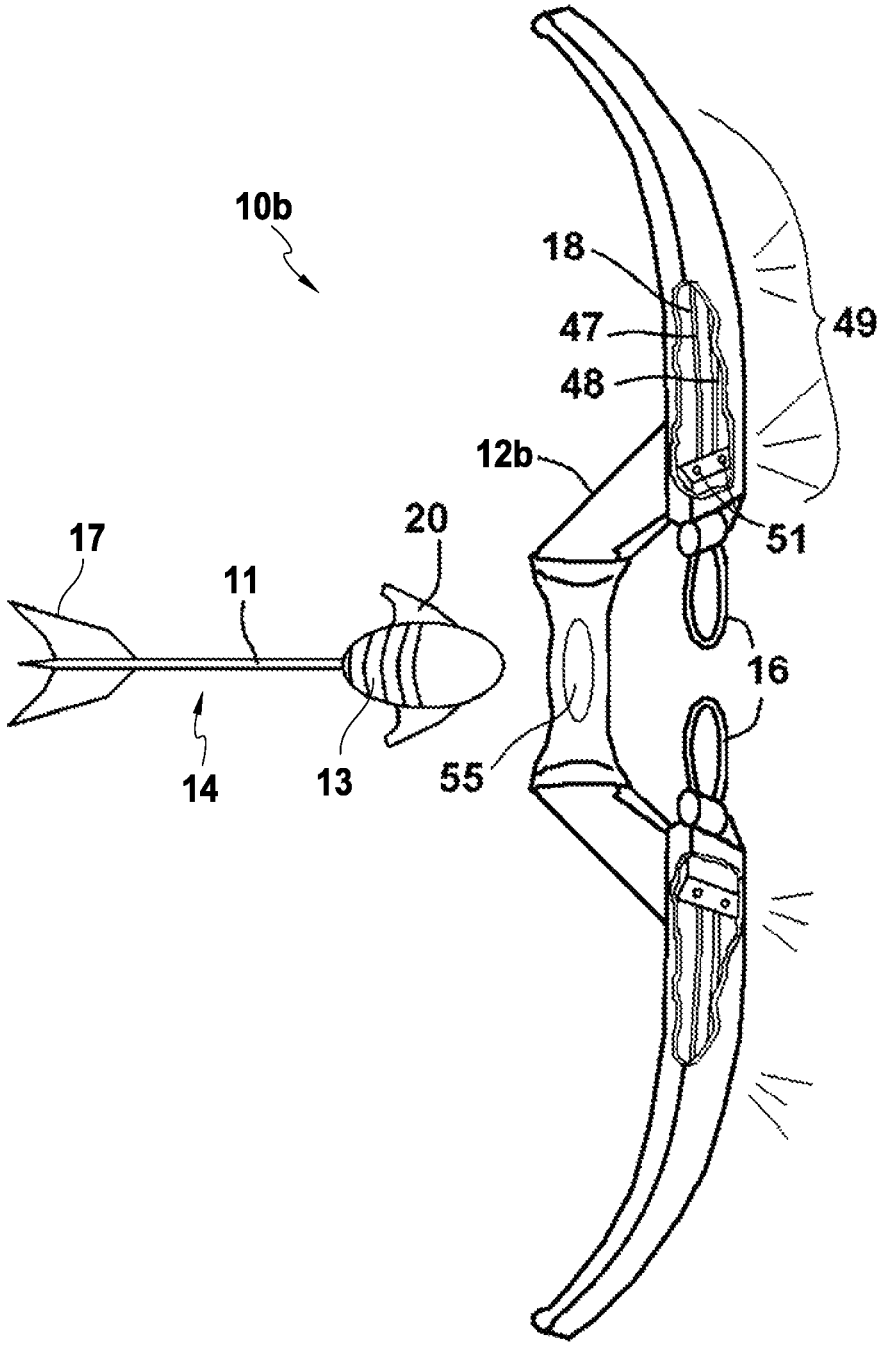
FIG. 4 is a perspective view of an exemplary embodiment of a toy bow and toy projectile in combination.

Referring to FIGS. 1 and 4, a bow and arrow system 10 (shown as system 10*a* and system 10*b*, but referred to generally as system 10) is shown. The bow and arrow system 10 includes a bow structure 12 (shown as bow 12*a* and bow 12*b*, but referred to generally as bow 12) and at least one arrow projectile 14. The bow structure 12 is rigid. The force used to propel the arrow projectile 14 is provided by two separate and distinct loading loops 16. The arrow projectile 14 has hook projections 20 that engage both of the loading loops 16. Elastic elements 18 extend through the loading loops 16. As a person engages an arrow projectile 14 with the loading loops 16 and pulls on the arrow projectile 14, the elastic elements 18 in the loading loops 16 stretch. Since there are two loading loops 16, the elastic element 18 in each of the loading loops 16 need only provide half the force needed to propel the arrow projectile 14 into flight. The elastic elements 18 are therefore difficult to overstretch in the proper operation of the toy. Furthermore, should either of the elastic elements 18 or loading loops 16 suddenly break, the orientation of the broken elastic elements 18 prevents the elastic elements 18 or the loading loops 16 from whipping toward the user. This dynamic is explained later in greater detail. Lastly, since the arrow projectile 14 engages two separate and distinct loading loops 16, the chances of the elastic elements 18 in both loading loops 16 breaking simultaneously are highly improbable. Accordingly, if one elastic element 18 breaks, the arrow projectile 14 will still be engaged by the other loading loop 16 and the person pulling the arrow projectile 14 back will not pull the arrow projectile 14 into himself upon the breakage of the one loading loop 16.

Figure 2:
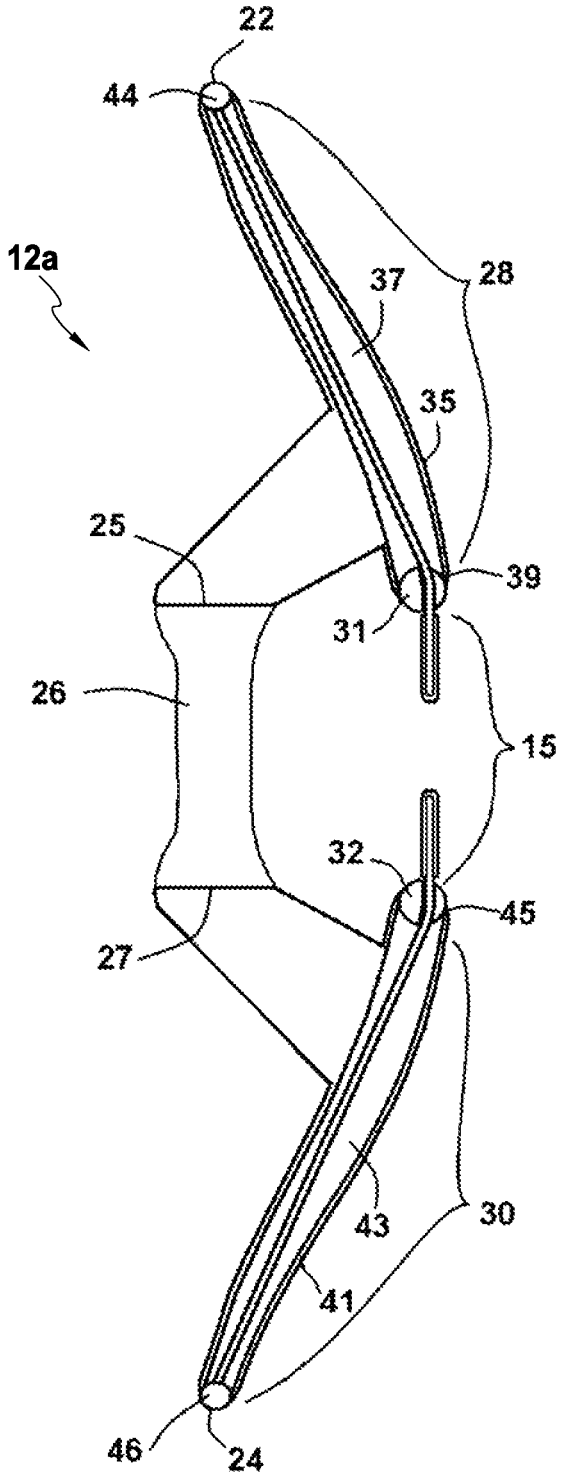
FIG. 2 is a side cross-sectional view of the toy bow shown in FIG. 1.
Figure 5:
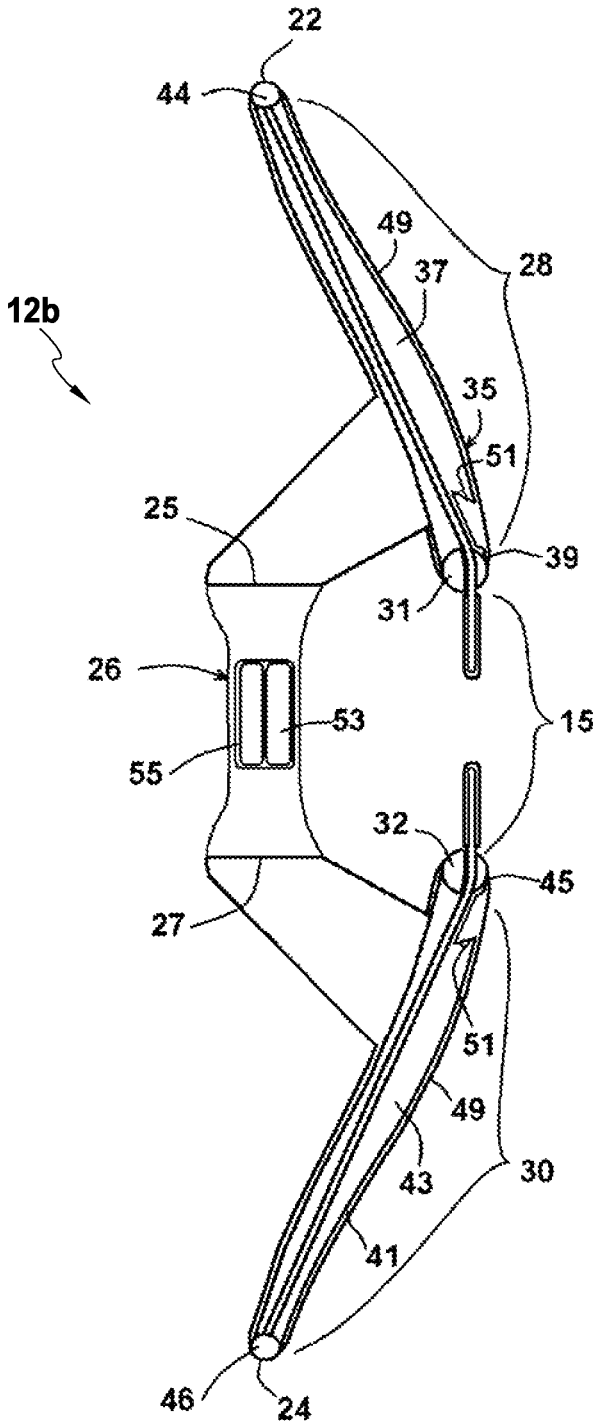
FIG. 5 is a side cross-sectional view of the toy bow shown in FIG. 4.

Referring to FIGS. 2 and 5 in conjunction with FIGS. 1 and 4, it can be seen that the bow structure 12 is a rigid molding. The bow structure 12 has a first end 22, a second end 24 and a handle 26 in its central region. The handle 26 has a top end 25 and a bottom end 27. A first arm section 28 is supported above the top end 25 of the handle 26. Likewise, a second arm section 30 is supported below the bottom end 27 of the handle 26. The first arm section 28 and the second arm section 30 are oriented in a common vertical plane. The handle 26 is offset from the common vertical plane so as not to interfere with the path of the arrow projectile 14. This creates an open central region 15, between the first and second arm sections 28, 30, that is defined by the handle 26.

Figure 3:
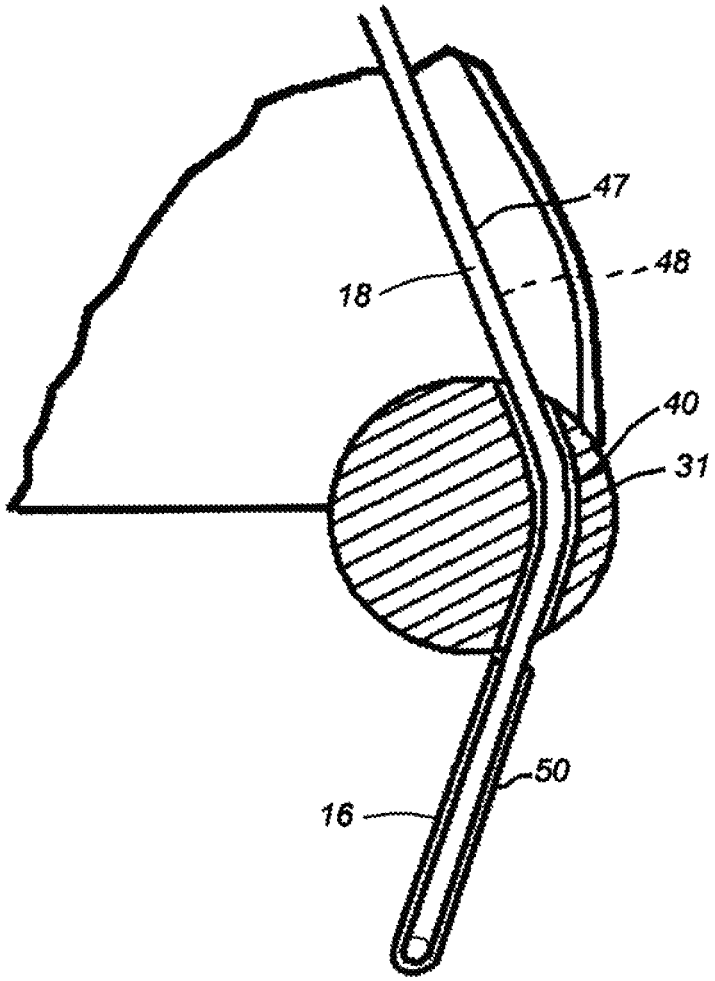
FIG. 3 is a cross-sectional view of a pivot post shown in FIG. 2.
Figure 6:
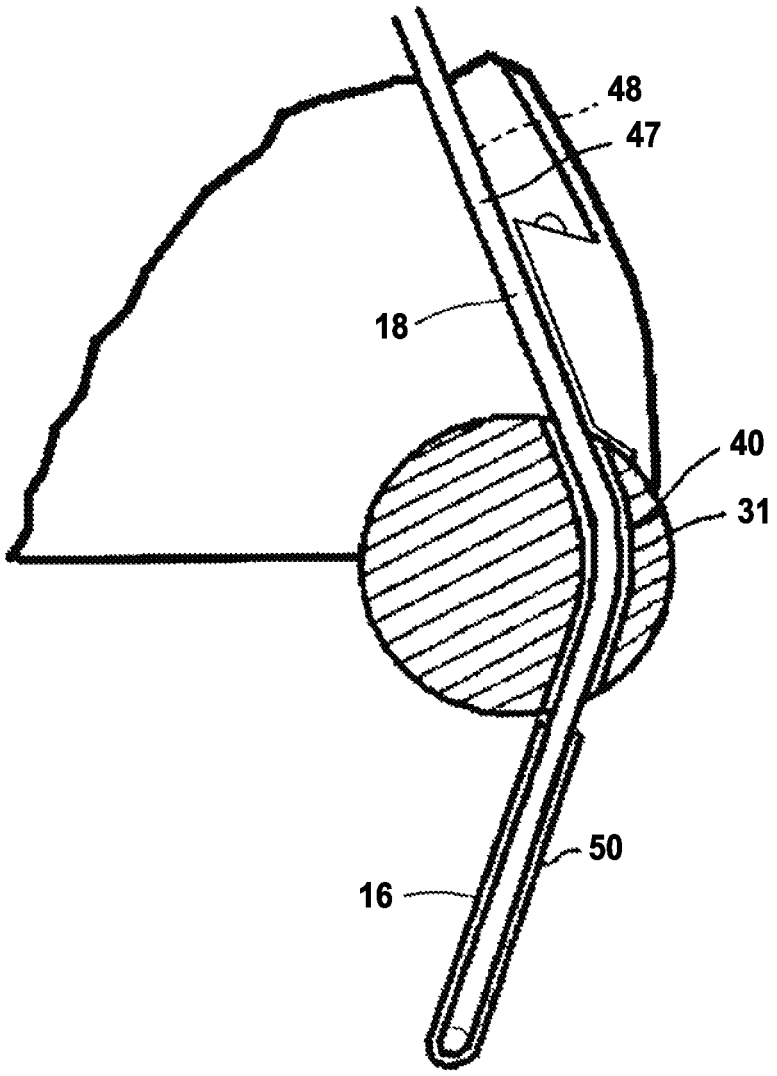
FIG. 6 is a cross-sectional view of a pivot post shown in FIG. 4.

The first arm section 28 contains a sheath structure 35 that defines a first internal compartment 37. The first internal compartment 37 has a bottom end 39 that faces toward the open central region 15. Likewise, the second arm section 30 contains a sheath structure 41 that defines a second internal compartment 43. The second internal compartment 43 has a top end 45 that faces toward the open central region 15. In FIGS. 1-3, both sheath structures 35, 41 are opaque. In FIGS. 4-6, both sheath structures 35, 41 have forward-facing surfaces 49 that are translucent.

FIGS. 4-6 also show one or more light emitting diodes 51 are mounted inside each of the sheath structures 35, 41. When the light emitting diodes 51 activate, they internally illuminate both the first internal compartment 37 and the second internal compartment 43. This internal illumination can be viewed from an external point through the translucent areas 49 on both sheath structures 35, 41. Although only one or a few light emitting diodes 51 may be used in each of the internal compartments 37, 43, the internal illumination causes the translucent areas 49 to glow brightly wherever they are backlit by the internal illumination.

The light emitting diodes 51 shown in FIGS. 4-6 are preferably monochromatic and emit light between the green and red wavelengths of the visible spectrum. Such light contains no significant ultraviolet components. The light produced by the light emitting diodes 51, therefore, produces no significant degradation in the polymers of the elastic elements 18. As such, the light emitting diodes 51 can emit bright light without adversely affecting the lifespan of the elastic elements 18.

The light emitting diodes 51 shown in FIGS. 4-6 are powered by batteries 53. The batteries 53 are contained within a battery compartment 55 that is manufactured into the bow structure 12*b*. Although a battery compartment can be positioned within the first arm section 28 or the second arm section 30, it is preferred that the battery compartment 55 be placed within the structure of the handle 26.

When using the bow and arrow system 10, a person grasps the handle 26 of the bow structure 12*b*. As such, it is preferred that if there is an on/off switch 55 (such as that shown in FIGS. 4-5) it be positioned on the handle 26 in a position that can easily be operated by a person grasping the handle 26 of the bow structure 12*b*. In the preferred embodiment, the on/off switch 55 is a normally "off" switch that turns "on" only when actively pressed. The on/off switch 55 can be integrated into the handle 26 so that the on/off switch is activated merely by firmly grasping the handle 26 of the bow structure 12*b*.

Two pivot post structures or post structures 31, 32 are mounted to the bow structure 12 outside the bottom opening 39 of the first sheath structure 35 and the top opening 45 of the bottom sheath structure 41. Referring now to FIGS. 2 and 5 in conjunction with FIGS. 3 and 6, it will be understood that although FIGS. 3 and 6 show only one of the post structures 31, the description offered stands for both post structures 31, 32 equally. Each pivot post structure 31, 32 defines two narrow channels 40. In FIGS. 3 and 6, only one channel 40 is shown. It will be understood that a second channel lay below the shown channel 40 in a parallel configuration.

Each of the loading loops 16 is a loop structure of an elastic element 18 that creates two runs 47, 48. The runs 47, 48 of each elastic element 18 extend through the sheath structures 35, 41 and through the two pivot posts 31, 32. Each elastic element 18 has two ends. Both ends of each elastic loop 18 are affixed to anchored posts 44, 46 within the sheath structure 35, 41. Since the runs 47, 48 of each elastic element 18 extend through the sheath structures 35, 41, it will be understood that the material of the elastic elements 18 is shielded from any external light exposure until the elastic elements 18 are stretched out of the channels 40 in the pivot post structures 31, 32.

The length of the elastic element 18 has a cross section that is smaller than the diameter of the channels 40 in the pivot post structures 31, 32. In this manner, a separate run 47, 48 of the elastomeric element 18 can pass through each of the openings 40, therein keeping the two runs 47, 48 of the loop apart.

As the runs 47, 48 of the elastic element 18 pass out of the pivot post structures 31, 32, the elastic element 18 immediately passes into reinforcement tubes 50 to form the loading loops 16. The diameters of the reinforcement tubes 50 are larger than the channels 40 in the pivot post structures 31, 32. Consequently, the reinforcement tubes 50 cannot pass through the pivot post structures 31, 32. As a result, each length of the elastic element 18 is divided into two runs 47, 48. The first run 47 extends between an anchor post and the reinforcement tube 50 on the far side of the pivot post structure. The second run 48 extends from the reinforcement tube 50 back to the anchor post. The looping of the elastic element 18 between the two runs 47, 48 curves the reinforcement tubes 50 and creates the two loading loops 16.

Additionally, the presence of the reinforcement tubes 50 protects the elastic element 18 inside the loading loops 16 from exposure to external light. Consequently, when the elastic elements 18 are at rest, the entire length of each of the elastic elements 18 is shielded from external ambient light.

Due to the offset of the handle 26, an open central region 15 exists between the two pivot post structures 31, 32. The loading loops 16 each extend into the open central region 15 from opposite sides.

Figure 7:
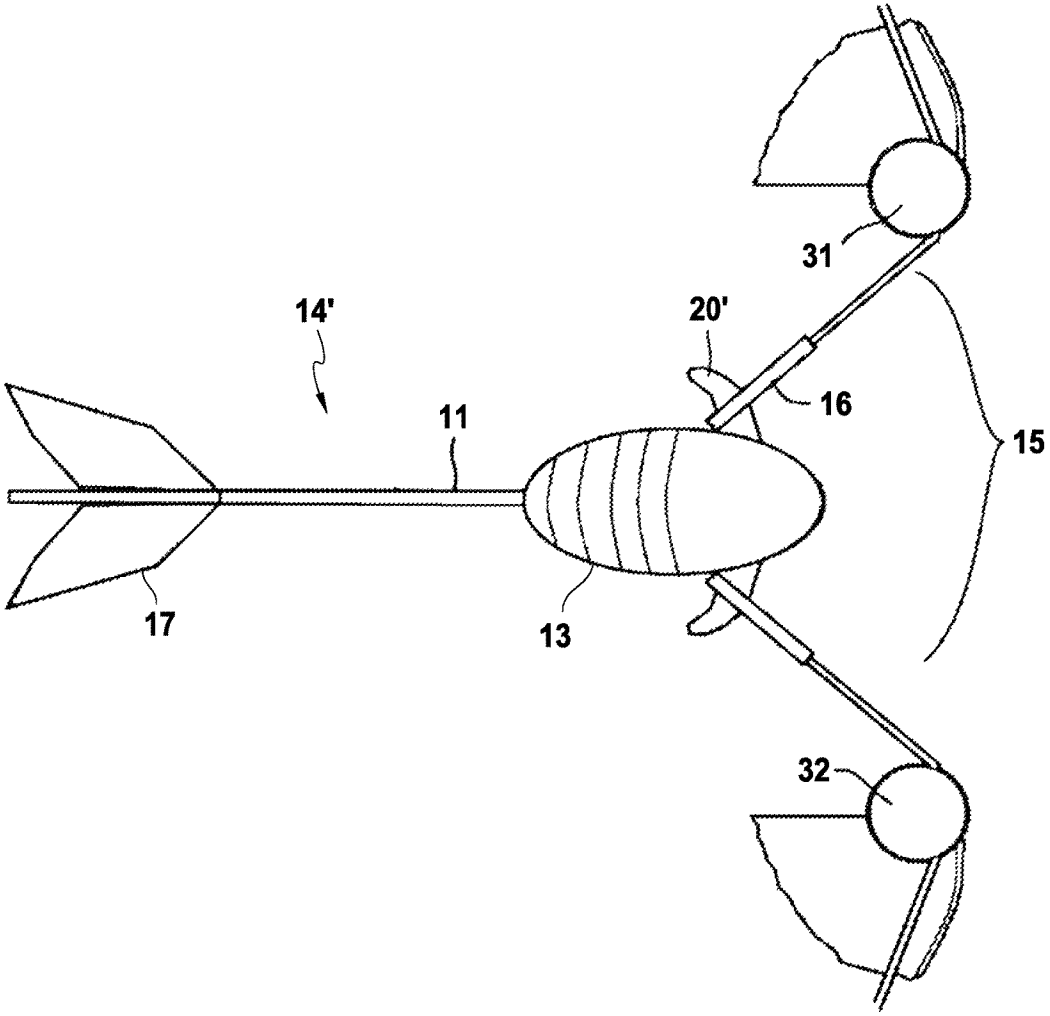
FIG. 7 shows a toy projectile engaging the loading loops within the central region of the toy bow.

Referring to FIG. 7 in conjunction with FIGS. 1 and 4, it can be seen that the arrow projectile 14' has two hook elements 20' extending from opposite sides. The hook elements 20' are sized and shaped to engage the two loading loops 16 as the hook elements 20' are pulled through the open central region 15. (The arrow projectile 14' and hook elements 20' have slightly different designs from, but are functionally equivalent to the arrow projectile 14 and hook elements 20 described in relationship with the other figures. Unless specified otherwise, the general phrases arrow projectile 14 and hook elements 20 (and equivalent phrases) are meant to encompass the arrow projectile 14' and hook elements 20' of FIG. 7.) To load the arrow projectile 14, the arrow projectile 14 is positioned within the open central region 15 so that the hook elements 20 engage the loading loops 16. Once engaged with the loading loops 16, the arrow projectile 14 is pulled in the manner of a traditional bow and arrow. As the arrow projectile 14 is pulled away from the open central region 15, the elastic elements 18 stretch. The elastic elements 18 bend around the pivot post structures 31, 32, therein enabling the loading loops 16 to move with the arrow projectile 14. This is the only time that parts of the elastic elements 18 are exposed to ambient light. This exposure lasts only for as long as the elastic elements 18 are stretched. Thus, the exposure to ambient light only lasts for a few seconds during each shot cycle.

As the elastic elements 18 stretch, they store energy. When the arrow projectile 14 is released, the elastic elements 18 retract and the arrow projectile 14 is accelerated toward the open central region 15. At the open central region 15, the loading loops 16 retract against the pivot post structures 31, 32. The momentum of the arrow projectile 14 causes the arrow projectile 14 to continue its forward movement beyond the open central region 15. This launches the arrow projectile 14 into flight as the hook elements 20 disengage the loading loops 16.

When the elastic elements 18 are stretched, they are most vulnerable to breakage. If one of the runs 47, 48 of an elastic element 18 breaks before passing through a pivot post structure 31, 32, then the speed of the contracting broken elastic element 18 is slowed by its passage through the pivot post structure 31, 32. This prevents a broken run from whipping toward a user. Furthermore, if the elastic element 18 were to break after it passes the pivot post structure 31, 32, most of the potential energy serves to move the broken elastic element 18 back toward the pivot post structure 31, 32 and away from the user.

Both immediate parent applications of the present application and the parent of the immediate parent applications describe the toy projectile 14 as having extending hooks 20 (also referred to as hook projections and hook elements) extending from opposite sides that engage the elastic elements of the toy bows 12. Both parent applications also show two versions of the toy projectile that are now shown as toy projectile 14 (FIGS. 1 and 4) and toy projectile 14' (FIG. 7) that are together referred to as toy projectiles 14. As shown, the toy projectiles 14 have a shaft 11 with a head end and a tail end. As shown, an enlarged head 13 is associated with the head end of the shaft 11. As shown, fletching or fins 17 are associated with the tail end of the shaft 11. As shown, two extending hooks 20 extend outward from opposite sides of the enlarged head 13 such that a first end of each extending hook 20 is associated with the enlarged head 13 and a second "free" end of each extending hook 20 is distal from the enlarged head 13. The "free" ends of the extending hooks 20 point away from the tip of the enlarged head 13 and generally extend towards the shaft 11 and fins 17.

It will be understood that the embodiment of the present invention that is illustrated and described is merely exemplary and that a person skilled in the art can make many variations to that embodiment. For instance, the bow structure can have many different ornamental shapes. The bow structure can also take the form of a crossbow. Likewise, the arrow projectiles can be configured as airplanes, rocket ships or any other flying projectile. All such embodiments are intended to be included within the scope of the present invention as defined by the claims.

What is claimed is:

1. A bow and arrow system, said system comprising:

a bow having a first arm section, a second arm section, and a central region between said first arm section and said second arm section;

said bow having a first bow element that provides half an arrow propelling force and a second bow element that provides half an arrow propelling force;

an arrow having a first extending nocking hook and a second extending nocking hook;

a first post structure associated with and perpendicular to said first arm section and near said central region;

a second post structure associated with and perpendicular to said second arm section and near said central region;

said first bow element associated with said first post structure; and said second bow element associated with said second post structure;

wherein said first extending nocking hook is configured to engage said first bow element, and said second extending nocking hook is configured to engage said second bow element.

2. The system of claim 1, said arrow having a shaft having a head end and a tail end, said arrow further comprising:

a head associated with said head end of said shaft; and said extending nocking hooks extending outward from said head.

3. The system of claim 1, wherein both said first bow element and said second bow element at least partially span said central region between said first arm section and said second arm section when said nocking hooks are not engaging said bow elements.

4. The system of claim 1, wherein said first bow element is associated with said first arm section and said second bow element is associated with said second arm section.

5. The system of claim 1, further comprising:

said first bow element being associated with said first arm section substantially near said central region; and said second bow element being associated with said second arm section substantially near said central region.

6. The system of claim 1:

said first arm section having an associated end and an unassociated end:

said associated end of said first arm section associated with said central region; and said unassociated end of said first arm section unassociated with said central region; and said second arm section having an associated end and an unassociated end:

said associated end of said second arm section associated with said central region; and said unassociated end of said second arm section unassociated with said central region.

7. The system of claim 1:

a said first arm section having a first end attached to said central region and a second end free from said central region; and said second arm section having a first end attached to said central region and a second end free from said central region.

8. The system of claim 1, wherein said first bow element and said second bow element together span more than half of said central region between said first arm section and said second arm section when said nocking hooks are not engaging said bow elements.

9. The system of claim 1, further comprising:

said first bow element extending into said central region;

said second bow element extending into said central region; and said first bow element and said second bow element together span more than half of said central region between said first arm section and said second arm section when said nocking hooks are not engaging said bow elements.

10. A toy bow and arrow system for use in children's play, said system comprising:

a toy bow having a first bow element that provides half a toy arrow propelling force and a second bow element that provides half a toy arrow propelling force;

said toy bow having a first arm section, a second arm section, and a central region between said first arm section and said second arm section;

a first post structure associated with and perpendicular to said first arm section and near said central region;

a second post structure associated with and perpendicular to said second arm section and near said central region;

said first bow element associated with said first post structure;

said second bow element associated with said second post structure;

a toy arrow having a shaft having a head end and a tail end, said toy arrow further comprising:

(i) a head is associated with said head end of said shaft; and (ii) a first extending nocking hook and a second extending nocking hook, said extending nocking hooks extending outward from said head; and said first extending nocking hook being configured to engage said first bow element, and said second extending nocking hook being configured to engage said second bow element.

11. The system of claim 10, said toy arrow is a safety-tipped arrow.

12. The system of claim 10, said head being a distinct head.

13. The system of claim 10, said head having sides, said extending nocking hooks extending outward from opposite sides of said head.

14. The system of claim 10, said head being an enlarged head, said head having sides, said extending nocking hooks extending outward from opposite sides of said head.

15. The system of claim 10, said head being a distinct head, said head having sides, said extending nocking hooks extending outward from opposite sides of said head.

16. The system of claim 10, a first end of each said extending nocking hook being associated with said head, a second end of each said extending nocking hook being distal from said head.

17. The system of claim 10, a first end of each said extending nocking hook being associated with said head, a second end of each said extending nocking hook being distal from said head, said second end extending toward said tail end.

18. The system of claim 10, wherein both said first bow element and said second bow element at least partially span said central region between said first arm section and said second arm section when said nocking hooks are not engaging said bow elements.

19. The system of claim 10, wherein said first bow element is indirectly associated with said first arm section and said second bow element is indirectly associated with said second arm section.

20. The system of claim 10, further comprising:

said first bow element being associated with said first arm section substantially near said central region; and said second bow element being associated with said second arm section substantially near said central region.

21. The system of claim 10, further comprising:

said first bow element being a first loop and said second bow element being a second loop;

wherein said first loop and said second loop together span more than half of said central region between said first arm section and said second arm section when said nocking hooks are not engaging said bow elements.

22. The system of claim 10, further comprising:

said first bow element being a first loop and said second bow element being a second loop;

wherein said first loop is associated with said first arm section and said second loop is associated with said second arm section.

23. The system of claim 10, further comprising:

said first bow element being a first loop and said second bow element being a second loop;

said first loop being associated with said first arm section substantially near said central region; and said second loop being associated with said second arm section substantially near said central region.

24. The system of claim 10:

said first arm section having an associated end and an unassociated end:

said associated end of said first arm section associated with said central region; and said unassociated end of said first arm section unassociated with said central region; and said second arm section having an associated end and an unassociated end:

said associated end of said second arm section associated with said central region; and said unassociated end of said second arm section unassociated with said central region.

25. The system of claim 10, further comprising:

said first bow element extending into said central region;

said second bow element extending into said central region; and said first bow element and said second bow element together span more than half of said central region between said first arm section and said second arm section when said nocking hooks are not engaging said bow elements.

26. The system of claim 10:

said first arm section having a first end attached to said central region and a second end free from said central region; and said second arm section having a first end attached to said central region and a second end free from said central region.

27. The system of claim 10, said first bow element and said second bow element together span more than half of said central region between said first arm section and said second arm section when said nocking hooks are not engaging said bow elements.

28. A bow and arrow system, said system comprising:

(a) a bow having a first arm section, a second arm section, and a central region between said first arm section and said second arm section:

(i) said first arm section having a first end attached to said central region and a second end free from said central region; and (ii) said second arm section having a first end attached to said central region and a second end free from said central region;

(b) said bow having a first bow element that provides half an arrow propelling force and a second bow element that provides half an arrow propelling force;

(c) an arrow having a shaft having a head end and a tail end, said head end having at least one nocking hook extending therefrom;

(d) a first post structure associated with and perpendicular to said first arm section and near said central region;

(e) a second post structure associated with and perpendicular to said second arm section and near said central region;

(f) said first bow element associated with said first post structure; and (g) said second bow element associated with said second post structure.

29. The system of claim 28, wherein said first bow element and said second bow element together span more than half of said central region between said first arm section and said second arm section in a resting position.

30. The system of claim 28, (a) said at least one nocking hook being a first nocking hook and a second nocking hook;

(b) said first nocking hook extending from said head end, said first nocking hook being configured to engage said first bow element;

(c) said second nocking hook extending from said head end, said second nocking hook being configured to engage said second bow element; and (d) wherein both said first bow element and said second bow element at least partially span said central region between said first arm section and said second arm section.

31. The system of claim 28, (a) said at least one nocking hook being a first nocking hook and a second nocking hook;

(b) said first nocking hook extending from said head end, said first nocking hook being configured to engage said first bow element;

(c) said second nocking hook extending from said head end, said second nocking hook being configured to engage said second bow element; and (d) wherein both said first bow element and said second bow element at least partially span said central region between said first arm section and said second arm section when said nocking hooks are not engaging said bow elements.

* * * * *